US011603231B2

(12) United States Patent
Oliveira et al.

(10) Patent No.: US 11,603,231 B2
(45) Date of Patent: Mar. 14, 2023

(54) CONTAINER WITH LINER

(71) Applicant: Graphic Packaging International, LLC, Atlanta, GA (US)

(72) Inventors: Steven M. Oliveira, Canton, GA (US); Raymond S. Kastanek, Mead, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 197 days.

(21) Appl. No.: 16/952,509

(22) Filed: Nov. 19, 2020

(65) Prior Publication Data

US 2021/0155366 A1 May 27, 2021

Related U.S. Application Data

(60) Provisional application No. 62/939,087, filed on Nov. 22, 2019.

(51) Int. Cl.
*B65D 5/24* (2006.01)
*B65D 5/56* (2006.01)
(Continued)

(52) U.S. Cl.
CPC ..... *B65D 5/244* (2013.01); *B31B 50/26* (2017.08); *B31B 50/60* (2017.08); *B65D 5/566* (2013.01); *B31B 2120/40* (2017.08)

(58) Field of Classification Search
CPC ..... B65D 5/244; B65D 5/566; B65D 81/343; B65D 5/606; B65D 5/3628; B65D 5/60;
(Continued)

(56) References Cited

U.S. PATENT DOCUMENTS 2,141,438 A * 12/1938 Hirsch ..... B65D 5/3642 229/199
2,832,270 A * 4/1958 Pierce, Jr. ..... B31B 50/00 53/449
(Continued)

FOREIGN PATENT DOCUMENTS

JP 3175928 U 6/2012
WO WO 2018/085136 A1 5/2018

OTHER PUBLICATIONS

International Search Report and Written Opinion for PCT/US2020/061214 dated Mar. 2, 2021.

*Primary Examiner* — Christopher R Demeree
(74) *Attorney, Agent, or Firm* — Womble Bond Dickinson (US) LLP

(57) ABSTRACT

A container for supporting a food product includes a tray and a liner. The tray includes a plurality of panels at least extending at least partially around an interior of the tray, the plurality of panels comprising a bottom panel, at least one side panel, at least one end panel, and at least one corner panel. The liner includes a central panel and at least one marginal panel each foldably connected to a gusset. The container is reconfigurable between a first configuration in which the at least one end panel and the at least one corner panel are in generally planar overlying relation with the respective bottom panel and the at least one side panel, with the liner positioned therebetween and with the gusset in a folded arrangement, and a second configuration in which the at least one side panel, the at least one end panel, and the at least one corner panel are generally upright relative to the bottom panel with the gusset in an expanded arrangement.

37 Claims, 6 Drawing Sheets

(51) Int. Cl.
*B31B 50/60* (2017.01)
*B31B 50/26* (2017.01)
*B31B 120/40* (2017.01)

(58) Field of Classification Search
CPC ..... B65D 5/3642; B65D 5/563; B65D 5/241; B65D 5/3678; B65D 5/603; B31B 50/26; B31B 50/60; B31B 2120/40; B31B 2105/00; B31B 2100/0024; B31B 2105/0024; B31D 5/0004
USPC ..... 206/557; 229/117.07, 117.32, 116.5, 229/164.2, 117.01, 117.27, 190; 493/96, 493/100, 84, 98; 53/456; 383/104, 120
See application file for complete search history.

(56) References Cited

U.S. PATENT DOCUMENTS 3,147,675 A * 9/1964 Cherrin ..... B65D 5/606 493/63
3,344,971 A * 10/1967 Walker ..... B65D 5/3614 229/117.32
3,459,357 A * 8/1969 Egger ..... B65D 5/606 53/449
3,519,160 A 7/1970 Lorenz, Jr. et al.
4,571,232 A 2/1986 Diehl
4,754,914 A * 7/1988 Wischusen, III ..... B65D 75/14 229/87.08
5,944,251 A * 8/1999 LaFleur ..... B65D 5/60 383/122
6,305,600 B1 10/2001 Hirschey et al.
8,002,171 B2 8/2011 Ryan et al.
8,152,326 B2 4/2012 House et al.
8,186,570 B2 5/2012 Learn
8,534,536 B2 9/2013 Mueller et al.
8,727,204 B2 5/2014 Burke
9,078,296 B2 7/2015 Fitzwater
9,113,648 B2 8/2015 Burke
9,463,896 B2 10/2016 Fitzwater
9,758,275 B2 9/2017 Fitzwater et al.
9,771,176 B2 9/2017 Kastanek et al.
9,957,080 B2 5/2018 Kastanek
10,023,349 B2 7/2018 Fitzwater
10,053,259 B2 8/2018 Gungner
10,086,972 B2 10/2018 Hajek
10,232,973 B2 3/2019 Burke
10,294,001 B2 5/2019 Fitzwater et al.
10,336,500 B2 7/2019 Burke
10,562,675 B2 2/2020 Walsh
10,640,271 B2 5/2020 Walsh
10,689,147 B2 * 6/2020 Nikolic ..... B65D 5/2033
10,737,824 B2 8/2020 Fitzwater et al.
10,961,014 B2 3/2021 Tart
11,059,255 B2 * 7/2021 Walsh ..... B31B 70/008
2022/0144477 A1 * 5/2022 Brink ..... B65D 5/2047

* cited by examiner

CONTAINER WITH LINER

CROSS-REFERENCE TO RELATED APPLICATION

This application claims the benefit of U.S. Provisional Patent Application No. 62/939,087, filed on Nov. 22, 2019.

INCORPORATION BY REFERENCE

The disclosure of U.S. Provisional Patent Application No. 62/939,087, filed on Nov. 22, 2019, is hereby incorporated by reference for all purposes as if presented herein in its entirety.

BACKGROUND OF THE DISCLOSURE

The present disclosure generally relates to containers such as cartons or trays for holding and/or heating food products or other types of articles. In one embodiment, the present disclosure relates containers with trays that include a liner.

SUMMARY OF THE DISCLOSURE

According to one aspect, the disclosure is generally directed to a container for supporting a food product, the container comprising a tray, the tray comprising a plurality of panels at least extending at least partially around an interior of the tray, the plurality of panels comprising a bottom panel, at least one side panel, at least one end panel, and at least one corner panel. The container further comprises a liner attached to the tray, the liner comprising a central panel and at least one marginal panel each foldably connected to a gusset. The container is reconfigurable between a first configuration in which the at least one end panel and the at least one corner panel are in generally planar overlying relation with the respective bottom panel and the at least one side panel, with the liner positioned therebetween and with the gusset in a folded arrangement, and a second configuration in which the at least one side panel, the at least one end panel, and the at least one corner panel are generally upright relative to the bottom panel with the gusset in an expanded arrangement.

According to another aspect, the disclosure is generally directed to the combination of a blank and a liner for forming a container for supporting a food product, the combination comprising the blank, the blank comprising a plurality of panels for at least extending at least partially around an interior of a tray formed from the blank, the plurality of panels comprising a bottom panel, at least one side panel, at least one end panel, and at least one corner panel. The combination further comprises the liner attached to the blank, the liner comprising a central panel and at least one marginal panel each foldably connected to a gusset. The blank and the liner are for being formed into the container, with the container being reconfigurable between a first configuration in which the at least one end panel and the at least one corner panel are in generally planar overlying relation with the respective bottom panel and the at least one side panel, with the liner positioned therebetween and with the gusset in a folded arrangement, and a second configuration in which the at least one side panel, the at least one end panel, and the at least one corner panel are generally upright relative to the bottom panel with the gusset in an expanded arrangement.

According to another aspect, the disclosure is generally directed to a method of forming a container for supporting a food product, the method comprising obtaining a blank, the blank comprising a plurality of panels comprising a bottom panel, at least one side panel, at least one end panel, and at least one corner panel. The method further comprises attaching a liner to the blank, the liner comprising a central panel and at least one marginal panel each foldably connected to a gusset, and folding the plurality of panels of the blank to form a tray in a folded configuration in which the at least one end panel and the at least one corner panel are in generally planar overlying relation with the respective bottom panel and the at least one side panel, with the liner positioned therebetween and with the gusset in a folded arrangement.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The containers of the present disclosure can be useful in supporting/containing a food product or other article such as any suitable type of food product that can be heated or cooked in a microwave oven. For example, the food product could include frozen food products or non-frozen food products. Some suitable food products could include French fries, chicken nuggets, fish sticks, mozzarella sticks, pizza, French bread pizza, sandwiches, calzones, turnovers, burritos, vegetables, popcorn, or any other suitable food product, any of which can be provided as a frozen or unfrozen food product. Further, the containers of the present disclosure can be used for heating, cooking, browning, crisping, etc. the food product by use of a heating or cooking device such as a conventional or microwave oven. It is understood that food products other than the food products listed herein may be contained in the disclosed packages and/or containers. Further, food products disclosed herein can be generally rectangular, triangular, round, square, irregular, or any other shape.

In this disclosure, the terms "lower," "bottom," "upper," and "top" indicate orientations determined in relation to fully erected and upright containers. As described herein, containers can be formed from blanks by overlapping multiple portions, components, and/or elements thereof. Such portions, components, and/or elements may be designated herein in terms relative to one another, e.g., "first", "second", "third", etc., in sequential or non-sequential reference, without departing from the disclosure.

Containers described herein can include a bag, liner, or wrap material comprising a relatively flexible material attached to a reinforcing construct, e.g., a tray, carton, etc., comprising a relatively rigid material (e.g., paperboard). The bags or liners can generally be made from a paper, plastic or other stock material and can be attached to the reinforcing construct. In one embodiment, the liners can comprise a polymeric material, e.g., plastic, such as polyethylene, a polyethylene terephthalate (PET) material, or any other thermoplastic material, or a bioplastic, such as vegetable oil or starch based plastics, or any other suitable material.

Figure 1:
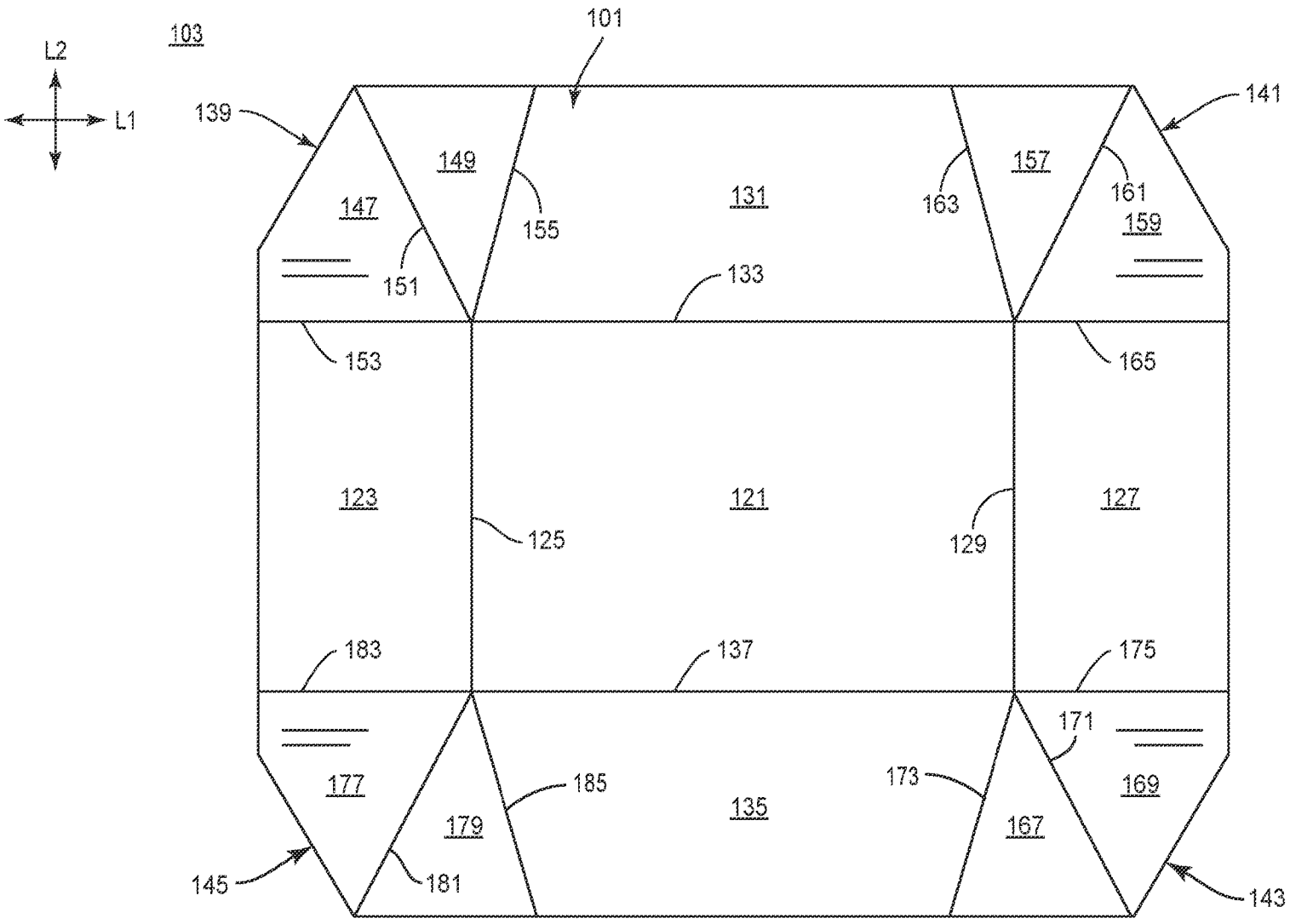
FIG. 1 is a plan view of a blank used to form a tray of a container according to an exemplary embodiment of the present disclosure.

FIG. 1 is a plan view of the exterior surface 101 of a blank, generally designated at 103, used to form a construct or tray 105 of a container 107, wherein the container 107 also includes a liner 109 (FIG. 2) attached to the tray 105 according to an exemplary embodiment of the disclosure.

While the container 107 herein is described as including a construct in the form of a tray, it will be understood that a construct having a different configuration can be provided, for example, a carton, bowl, plate, etc.

The blank 103 has a longitudinal axis L1 and a lateral axis L2. The blank 103, as shown, includes a central panel or bottom panel 121, a first end panel 123 foldably connected to the bottom panel 121 at a lateral fold line 125, a second end panel 127 foldably connected to the bottom panel 121 at a lateral fold line 129, a first side panel 131 foldably connected to the bottom panel 121 at a longitudinal fold line 133, and a second side panel 135 foldably connected to the bottom panel 121 at a longitudinal fold line 137.

The blank 103 also includes a first corner panel 139 between the end panel 123 and the side panel 131, a second corner panel 141 between the side panel 131 and the end panel 127, a third corner panel 143 between the end panel 127 and the side panel 135, and a fourth corner panel 145 between the side panel 135 and the end panel 123.

The corner panel 139, as shown, can include an end section 147 foldably connected to a side section 149 at an oblique fold line 151, with the end section 147 separably connected to the end panel 123 at a longitudinal cut 153 and the side section 149 foldably connected to the side panel 131 at an oblique perforation or oblique fold line 155. Similarly, the corner panel 141 includes a side section 157 foldably connected to an end section 159 at an oblique fold line 161, with the side section 157 foldably connected to the side panel 131 at an oblique perforation or oblique fold line 163 and the end section 159 separated from the end panel 127 at a longitudinal cut 165.

Further, the corner panel 143 can include a side section 167 foldably connected to an end section 169 at an oblique fold line 171, with the side section 167 foldably connected to the side panel 135 at an oblique perforation or oblique fold line 173 and the end section 169 separated from the end panel 127 at a longitudinal cut 175. The corner panel 145 includes an end section 177 foldably connected to a side section 179 at an oblique fold line 181, with the end section 177 separated from the end panel 123 at a longitudinal cut 183 and the side section 179 foldably connected to the side panel 135 at an oblique perforation or oblique fold line 185.

Figure 2:
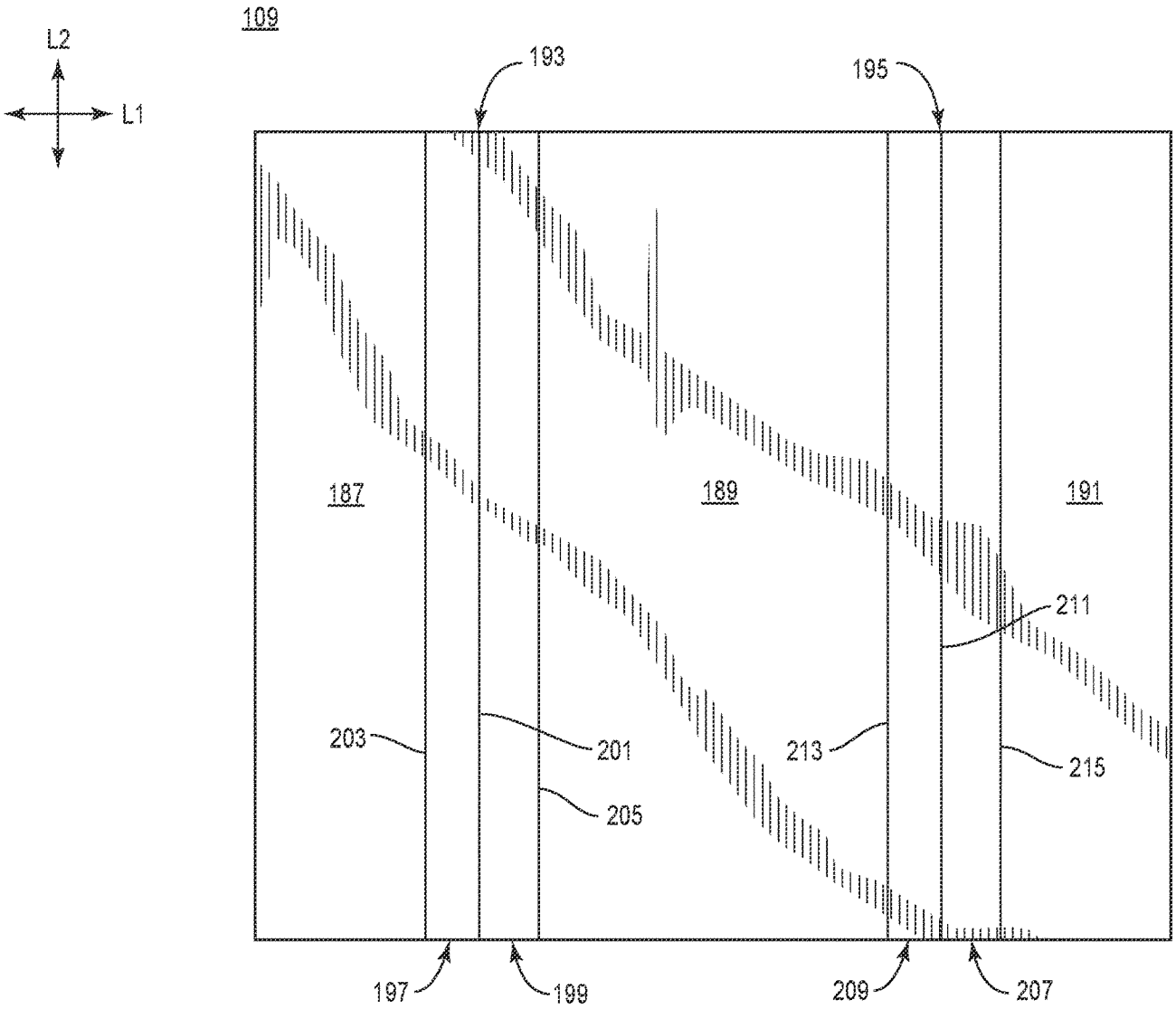
FIG. 2 is a plan view of a liner for use with the blank of FIG. 1 to form a container according to an exemplary embodiment of the disclosure.

Referring to FIG. 2, the liner 109 has the longitudinal axis L1 and the lateral axis L2 and includes a first panel or first marginal panel 187, a central panel 189, and a second panel or second marginal panel 191, with a first gusset 193 between the marginal panel 187 and the central panel 189, and a second gusset 195 between the central panel 189 and the marginal panel 191.

The first gusset 193, as shown, can include a first gusset panel 197 foldably connected to a second gusset panel 199 at a longitudinal fold line 201, with the first gusset panel 197 foldably connected to the marginal panel 187 at a longitudinal fold line 203 and the second gusset panel 199 foldably connected to the central panel 189 at a longitudinal fold line 205. Similarly, the second gusset 195 can include a first gusset panel 207 foldably connected to a second gusset panel 209 at a longitudinal fold line 211, with the first gusset panel 207 foldably connected to the marginal panel 191 at a longitudinal fold line 215 and the second gusset panel 209 foldably connected to the central panel 189 at a longitudinal fold line 213.

Figure 3:
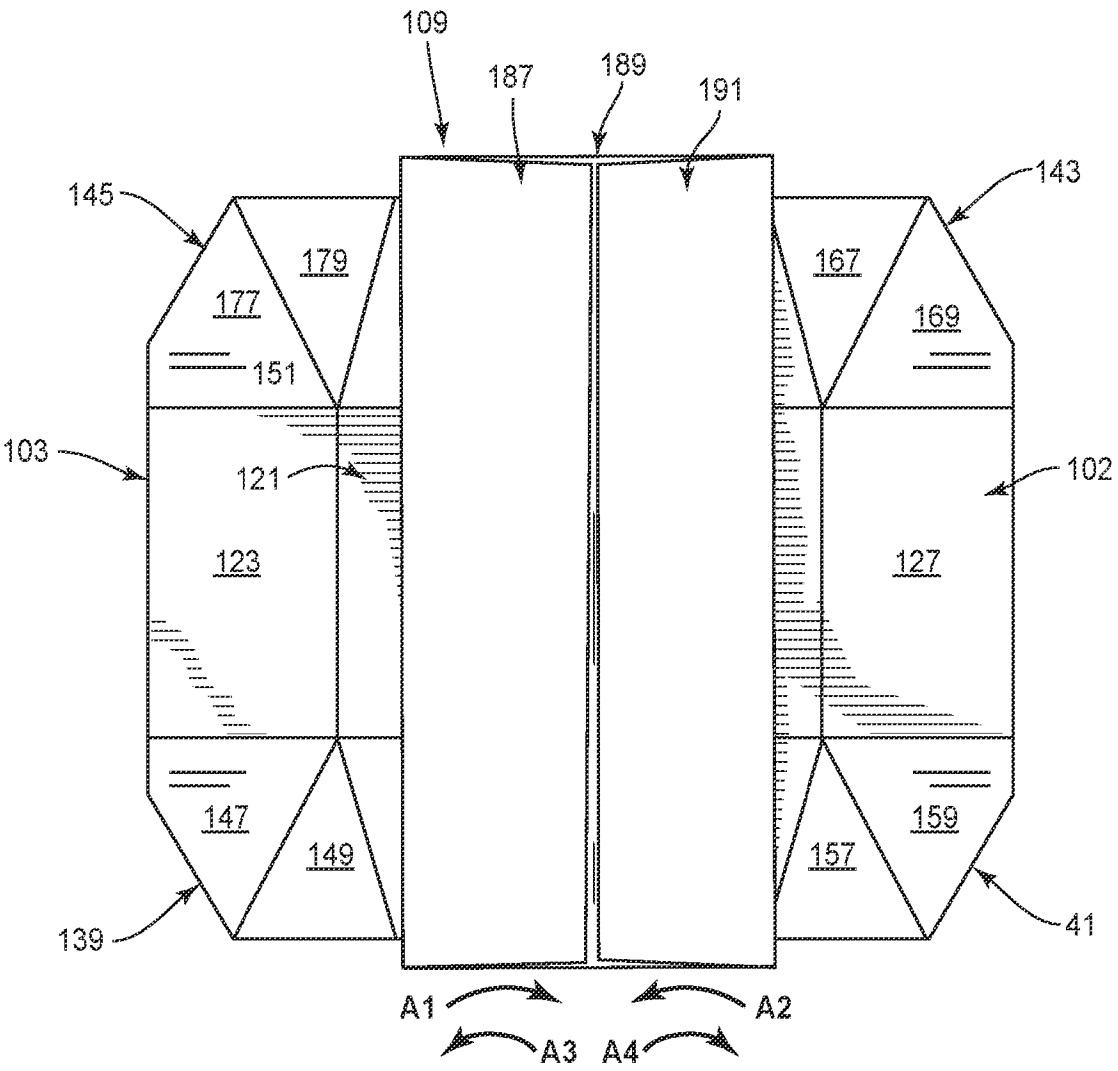
FIG. 3 is a first sequential plan view of a folding of the blank of FIG. 1 and the liner of FIG. 2 to form a container according to an exemplary embodiment of the disclosure.

With additional reference to FIG. 3, in order to form the container 107 according to one exemplary embodiment of the disclosure, the blank 103 can be flipped over/inverted on a supporting surface so that the exterior surface 101 is facing downward and an interior surface 102 is facing upward. The liner 109 can be attached to the interior surface 102 of the blank 103, for example, with the central panel 189 positioned in at least partial face-to-face contact with respective portions of the side panel 131, the bottom panel 121, and the side panel 135, with the marginal panel 187 positioned in at least partial face-to-face contact with respective portions of the corner panel 139, end panel 123, and corner panel 145, and with the second marginal panel 191 positioned in at least partial face-to-face contact with respective portions of the corner panel 141, the end panel 127, and the corner panel 143.

The liner 109 can be attached to one or more of the panels 121, 123, 127, 131, 135, 139, 141, 143, 145, for example, with an adhesive such as glue, by heat sealing, press forming, lamination, etc. Alternatively, the blank 103/tray 105 can have features (e.g., openings, attachments flaps, or other attachment features) that can attach the liner 109 to the blank 103/tray 105 without adhesives.

The marginal panel 187/gusset 193 and the marginal panel 191/gusset 195 of the liner 109 can be folded at the respective fold lines 205, 213 in the direction of the respective arrows A1, A2 into at least partial face-to-face contact with respective portions of the central panel 189 of the liner 109.

Simultaneously or thereafter, the gusset panel 197 can be folded back at the fold line 201 in the direction of the arrow A3 into at least partial face-to-face contact with the gusset panel 199, and the gusset panel 207 can be folded back at the fold line 211 in the direction of the arrow A4 into at least partial face-to-face contact with the gusset panel 209. Upon the aforementioned folded arrangement of the gussets 193, 195, a portion of the marginal panel 187 can be in face-to-face contact with the first gusset panel 197, the first gusset panel 197 can be in face-to-face contact with the second gusset panel 199, and the second gusset panel 199 can be in face-to-face contact with a portion of the central panel 189. Similarly, a portion of the marginal panel 191 can be in face-to-face contact with the first gusset panel 207, the first gusset panel 207 can be in face-to-face contact with the second gusset panel 209, and the second gusset panel 209 can be in face-to-face contact with a portion of the central panel 189.

In this regard, the folded arrangement of the gusset panels 197, 199 and the gusset panels 207, 209 described above provide a folded/layered or accordion-like configuration of the gussets 193, 195 that can be unfolded or unfurled upon further formation of the container 107 to a folded arrangement, as described further below.

Figure 4:
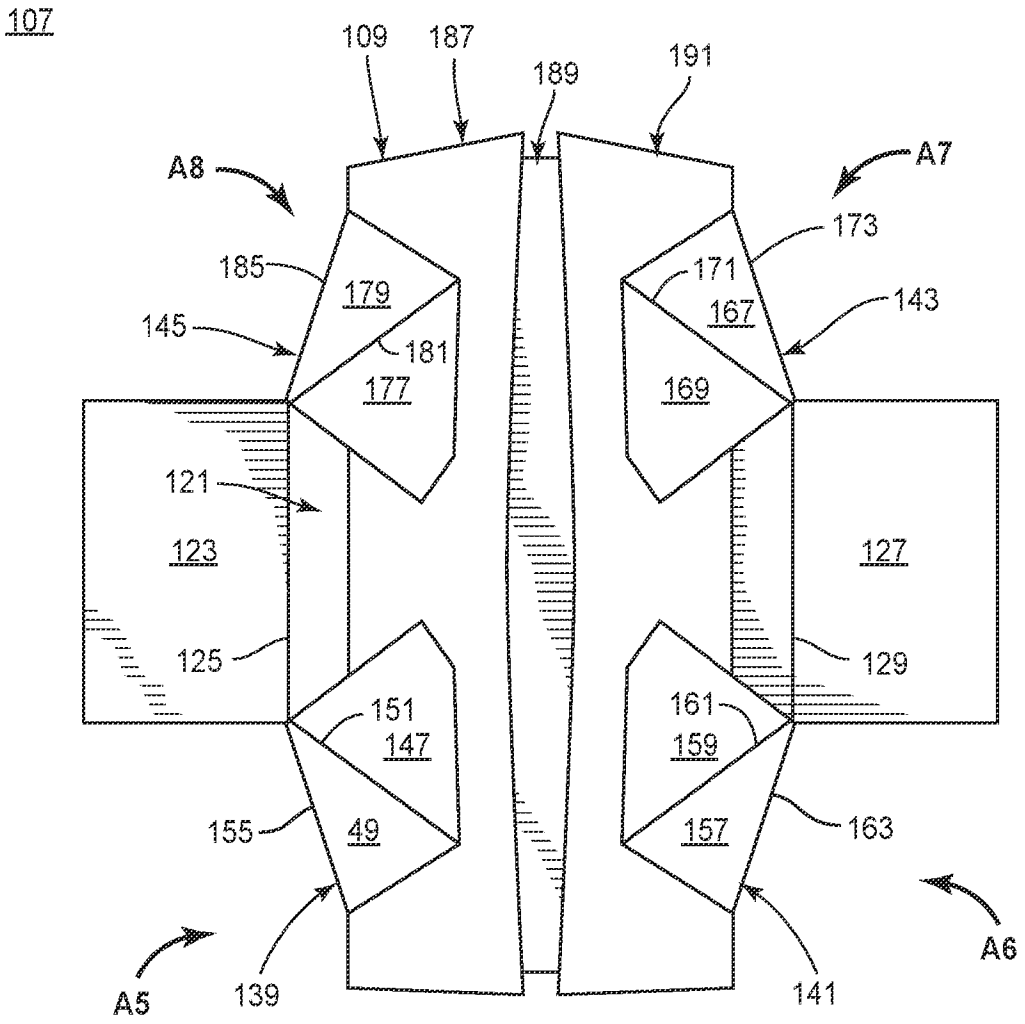
FIG. 4 is a second sequential plan view of the folding of the blank of FIG. 1 and the liner of FIG. 2.

Turning to FIG. 4, the corner panels 139, 141, 143, 145 can be folded at the respective oblique fold lines 155, 163, 173, 185 in the direction of the respective arrows A5, A6, A7, A8 into at least partial face-to-face contact with respective portions of the bottom panel 121 and the marginal panels 187, 191 of the liner 109.

Figure 5:
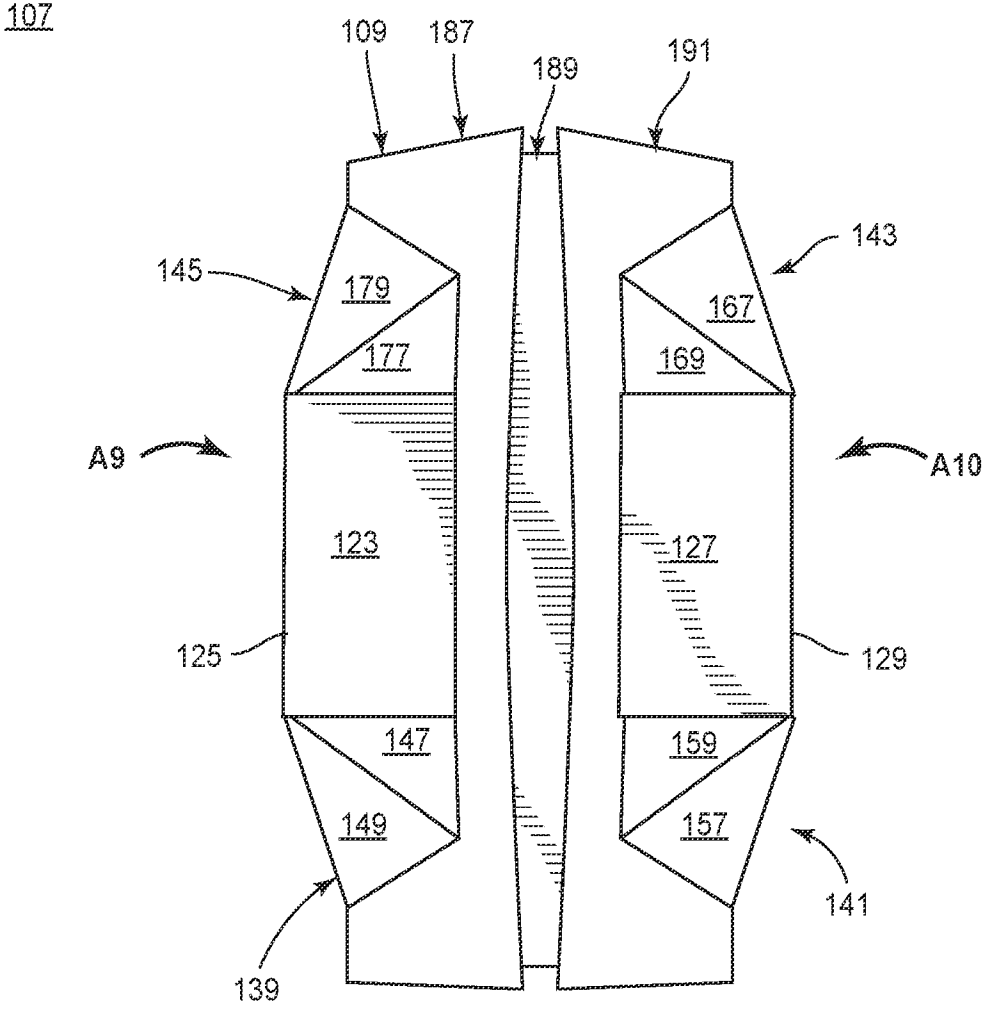
FIG. 5 is a third sequential plan view of the folding of the blank of FIG. 1 and the liner of FIG. 2.

Thereafter, and with additional reference to FIG. 5, the end panel 123 can be folded at the lateral fold line 125 in the direction of the arrow A9 into at least partial face-to-face contact with respective portions of the corner panels 139, 145 and a respective portion of the bottom panel 121, and the end panel 127 can be folded at the lateral fold line 129 in the direction of the arrow A10 into at least partial face-to-face contact with respective portions of the corner panels 141, 143 and a respective portion of the bottom panel 121.

In particular, longitudinal edge portions of the end panel 123 are positioned in at least partial face-to-face contact with the respective end sections 147, 177 of the corner panels 139, 145, and longitudinal edge portions of the end panel 127 are positioned in at least partial face-to-face contact with the respective end sections 159, 169 of the respective corner panels 141, 143. Such an arrangement can be maintained with an adhesive such as glue.

The aforementioned folded configuration of the container 107, in which the end panels 123, 127 and corner panels 139, 131, 143, 145 of the tray 105 are in overlying, generally planar relation with respective portions of the side panels 131, 135 and the bottom panel 121, and with the liner 109 folded therebetween, can be a first/folded/shipping/stacking configuration of the container 107. Such first configuration of the container 107 has a generally flat or minimal side profile, and provides a space-saving arrangement of the container 107 that is suitable, for example, for storage, stacking, shipping, etc.

Figure 6:
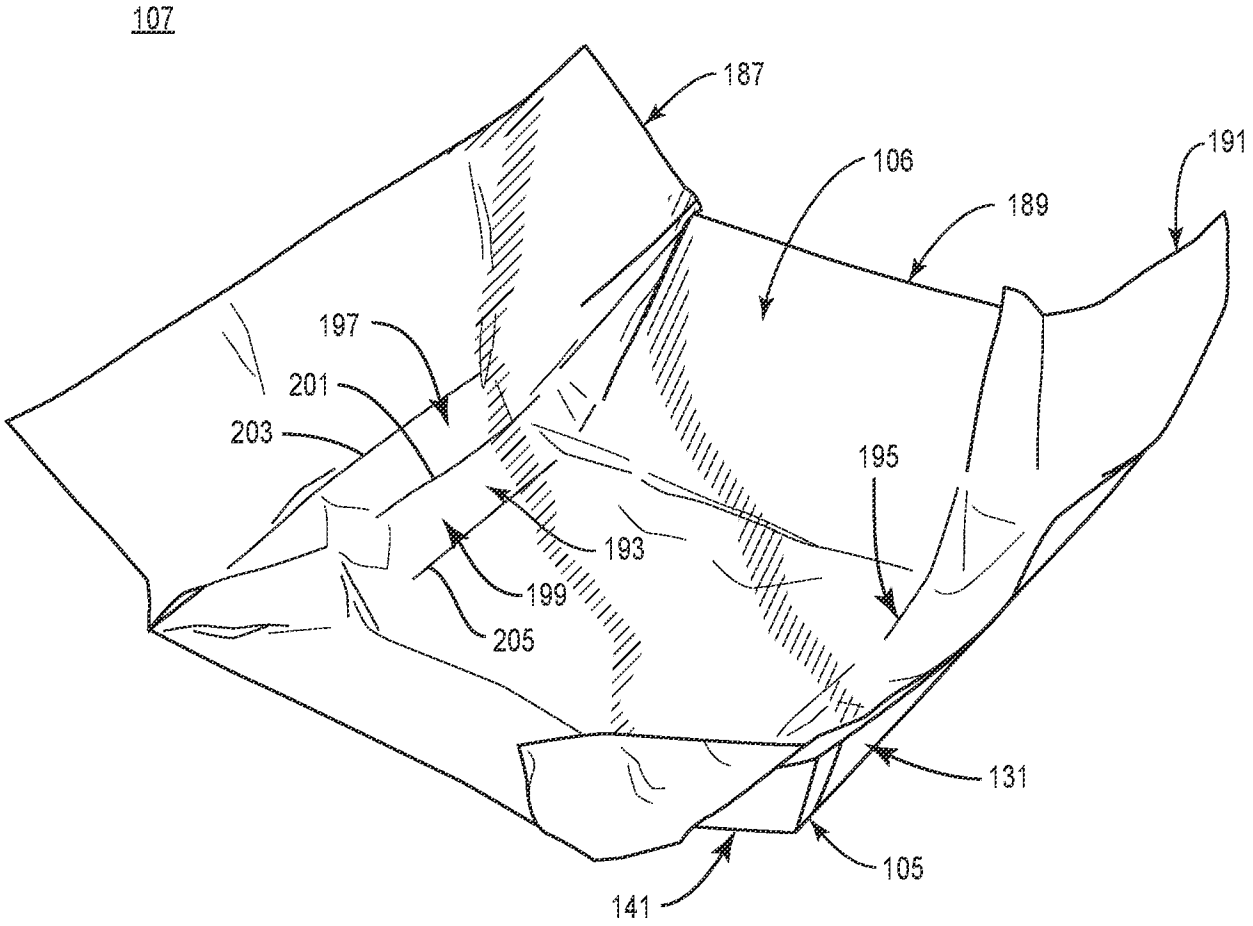
FIG. 6 is a perspective view of a container formed from the blank of FIG. 1 and the liner of FIG. 2 according to an exemplary embodiment of the disclosure.

In order to transition/reconfigure the container 107 from the first configuration to a second/erected/serving configuration, as illustrated in FIG. 6, in one embodiment, a user can engage the end panels 123, 127 and fold the end panels 123, 127 at least partially upwardly at the respective fold lines 125, 129 to be in a generally oblique/upright position relative to the bottom panel 121.

Such movement of the end panels 123, 127 can urge/move the corner panels 139, 141, 143, 145 to fold/flex at the respective oblique fold lines 151, 161, 171, 181 such that the respective corner sections 147, 149, corner sections 157, 159, corner sections 167, 619, and corner sections 177, 179 are positioned in oblique relation to define respective corners of the container 107.

The further movement of the corner panels 139, 145 and corner panels 141, 143 described above can urge/move the respective side panels 131, 135 to fold at least partially upwardly at the respective fold lines 133, 137 toward a generally oblique/upright positioned relative to the bottom panel 121. In the second configuration of the container 107 illustrated in FIG. 6, the liner 109/panels 121, 123, 127, 131, 135, 139, 141, 143, 145 extend around an interior 106 of the container 107.

The aforementioned folding/unfolding of the container 107 from the first configuration to the second configuration can cause the gussets 193, 195 of the liner 109 to unfurl/unfold to an expanded arrangement, for example, such that the gusset panels 197, 199 are folded away from one another at the fold line 201 and away from the respective first marginal panel 187 and central panel 189 at the respective fold lines 203, 205, and such that the gusset panels 207, 209 are folded away from one another at the fold line 211 and away from the respective central panel 189 and second marginal panel 191 at the respective fold lines 213, 215.

In this regard, the marginal panels 187, 191 of the liner 109 can be carried away from the interior 106 of the container 107 with the respective end panels 123, 127, and the gussets 193, 195 provide a region of expandability or slack that avoids tension or pulling on the central panel 189 of the liner 109 to maintain the liner 109 in a generally aligned position with the tray 105.

As shown, in the second configuration of the container, the liner 109 can be arranged relative to the tray 105 such that the central panel 189 of the liner 109 is in general overlying relation with at least a central portion of the bottom panel 121 and side panels 131, 135 of the tray 105. Furthermore, the gusset 193 can be in general overlying relation with respective portions of the end panel 123 and bottom panel 121 proximate the fold line 125, in addition to respective portions of the corner panels 139, 145. The first marginal panel 187 of the liner 109 can be positioned in general overlying relation with respective portions of the end panel 123 and corner panels 139, 145. The gusset 195 and second marginal panel 191 of the liner 109 can have a similar generally overlying arrangement with respect to respective portions of the bottom panel 121, end panel 127, and corner panels 141, 143.

As also shown, longitudinal and lateral marginal portions of the liner 109 can extend beyond the top edges of the respective panels 121, 123, 127, 131, 135, 139, 141, 143, 145 such that the liner 109 provides at least full coverage of the interior surface of the tray 105, for example, for providing a food-contacting surface or barrier between one or more food products and the tray 105.

In this regard, the folded configuration of the gussets 193, 195 contributes to the space-saving arrangement of the first configuration of the container 107, and, upon erection of the container 107 from the first configuration to the second configuration as described above, the gussets 193, 195 expand to allow the respective end panels 123, 127 to fold away from the bottom panel 121 without pulling or shifting the central panel 189 of the liner 109 from a general alignment with the bottom panel 121.

Such a configuration of the container 107 allows for the liner 109 to be attached to the blank 103 prior to formation of the container 107 to provide a unitary or one-piece/attached structure, with the liner 109 foldable (via the gussets 193, 195) in a manner such that the container 107 can be transitioned/reconfigured from the first configuration to the second configuration while maintaining the general position of the liner 109 overlying the blank 103/tray 105 and such that no additional application of the liner 109 to the tray 105 is required after the initial application of the liner 109 to the blank 103. Accordingly, manufacturing and formation of the container 107 can be streamlined at an initial formation thereof, and the container 107 can be shipped as a unitary/single-piece article in the first configuration to an end user (i.e., a retailer or customer) such that the end user can quickly raise the panels 123, 127, 131, 135, 139, 141, 143, 145 to provide the container 107 in the second configuration that is fully covered by the liner 109 and ready for use. It will be understood that the container 107 is transitionable/reconfigurable between the first configuration and the second configuration, for example, by reversing the steps outlined above.

In general, any blank as described above may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the tray embodiments. The term "glue" is intended to encompass all manner of adhesives commonly used to secure tray panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A container for supporting a food product, the container comprising:

a tray, the tray comprising:

a plurality of panels at least extending at least partially around an interior of the tray, the plurality of panels comprising a bottom panel, at least one side panel, at least one end panel, and at least one corner panel; and a liner attached to the tray, the liner comprising:

a central panel and at least one marginal panel each foldably connected to a gusset, the container is reconfigurable between a first configuration in which the at least one end panel and the at least one corner panel are in generally planar overlying relation with the respective bottom panel and the at least one side panel, with the liner positioned therebetween and with the gusset in a folded arrangement, and a second configuration in which the at least one side panel, the at least one end panel, and the at least one corner panel are generally upright relative to the bottom panel with the gusset in an expanded arrangement.

2. The container of claim 1, wherein the at least one end panel is in at least partial face-to-face contact with a portion of the at least one corner panel.

3. The container of claim 2, wherein the at least one side panel is attached to the at least one corner panel such that when the container is reconfigured between the first configuration and the second configuration, movement of the at least one end panel causes movement of the at least one side panel.

4. The container of claim 2, wherein the at least one corner panel comprises an end section separated from the at least one end panel at a cut and a side section foldably connected to the at least one side panel at a fold line.

5. The container of claim 4, wherein the gusset of the liner comprises a first gusset panel foldably connected to the at least one marginal panel and a second gusset panel foldably connected to each of the first gusset panel and the central panel.

6. The container of claim 5, wherein, in the folded arrangement of the gusset, a portion of the at least one marginal panel is in face-to-face contact with the first gusset panel, the first gusset panel is in face-to-face contact with the second gusset panel, and the second gusset panel is in face-to-face contact with a portion of the central panel.

7. The container of claim 6, wherein, in the folded arrangement of the gusset, a portion of the at least one marginal panel is in face-to-face contact with a portion of the central panel.

8. The container of claim 2, wherein, in the second configuration of the container, the at least one marginal panel extends past a top edge of the at least one side panel.

9. The container of claim 1, wherein the at least one marginal panel of the liner is a first marginal panel foldably connected to a first gusset, and the liner further comprises a second marginal panel foldably connected to a second gusset, each gusset foldably connected to the central panel.

10. The container of claim 9, wherein each gusset comprises a first gusset panel foldably connected to a second gusset panel, the second gusset panel foldably connected to the central panel.

11. The container of claim 10, wherein the at least one corner panel is a first corner panel and the at least one end panel is a first end panel separated from the first corner panel, the at least one side panel is a first side panel foldably connected to the first corner panel, and the plurality of panels further comprises a second end panel, a second corner panel foldably connected to the first side panel and separated from the second end panel, a second side panel, a third corner panel separated from the second end panel and foldably connected to the second side panel, and a fourth corner panel separated from the first end panel and foldably connected to the second side panel.

12. The container of claim 11, wherein each corner panel comprises an end section foldably connected to a side section.

13. The container of claim 1, wherein the tray is formed from paperboard and the liner is formed from a polymeric material.

14. In combination, a blank and a liner for forming a container for supporting a food product, the combination comprising:

the blank, the blank comprising a plurality of panels for at least extending at least partially around an interior of a tray formed from the blank, the plurality of panels comprising a bottom panel, at least one side panel, at least one end panel, and at least one corner panel; and the liner attached to the blank, the liner comprising a central panel and at least one marginal panel each foldably connected to a gusset, the blank and the liner are for being formed into the container, with the container being reconfigurable between a first configuration in which the at least one end panel and the at least one corner panel are in generally planar overlying relation with the respective bottom panel and the at least one side panel, with the liner positioned therebetween and with the gusset in a folded arrangement, and a second configuration in which the at least one side panel, the at least one end panel, and the at least one corner panel are generally upright relative to the bottom panel with the gusset in an expanded arrangement.

15. The combination of claim 14, wherein the at least one end panel is for being positioned in at least partial face-to-face contact with a portion of the at least one corner panel when the container is formed from the blank and the liner.

16. The combination of claim 15, wherein the at least one side panel is attached to the at least one corner panel such that when the container formed from the blank and the liner is reconfigured between the first configuration and the second configuration, movement of the at least one end panel causes movement of the at least one side panel.

17. The combination of claim 15, wherein the at least one corner panel comprises an end section separated from the at least one end panel at a cut and a side section foldably connected to the at least one side panel at a fold line.

18. The combination of claim 17, wherein the gusset of the liner comprises a first gusset panel foldably connected to the at least one marginal panel and a second gusset panel foldably connected to each of the first gusset panel and the central panel.

19. The combination of claim 15, wherein, the at least one marginal panel extends past a top edge of the at least one side panel.

20. The combination of claim 14, wherein the at least one marginal panel of the liner is a first marginal panel foldably connected to a first gusset, and the liner further comprises a second marginal panel foldably connected to a second gusset, each gusset foldably connected to the central panel.

21. The combination of claim 20, wherein each gusset comprises a first gusset panel foldably connected to a second gusset panel, the second gusset panel foldably connected to the central panel.

22. The combination of claim 21, wherein the at least one corner panel is a first corner panel and the at least one end panel is a first end panel separated from the first corner panel, the at least one side panel is a first side panel foldably connected to the first corner panel, and the plurality of panels further comprises a second end panel, a second corner panel foldably connected to the first side panel and separated from the second end panel, a second side panel, a third corner panel separated from the second end panel and foldably connected to the second side panel, and a fourth corner panel separated from the first end panel and foldably connected to the second side panel.

23. The combination of claim 22, wherein each corner panel comprises an end section foldably connected to a side section.

24. The combination of claim 14, wherein the blank is formed from paperboard and the liner is formed from a polymeric material.

25. A method of forming a container for supporting a food product, the method comprising:

obtaining a blank, the blank comprising a plurality of panels comprising a bottom panel, at least one side panel, at least one end panel, and at least one corner panel;

attaching a liner to the blank, the liner comprising a central panel and at least one marginal panel each foldably connected to a gusset;

folding the plurality of panels of the blank to form a tray in a folded configuration in which the at least one end panel and the at least one corner panel are in generally planar overlying relation with the respective bottom panel and the at least one side panel, with the liner positioned therebetween and with the gusset in a folded arrangement.

26. The method of claim 25, wherein the folding the plurality of panels comprises positioning the at least one end panel in at least partial face-to-face contact with a portion of the at least one corner panel.

27. The method of claim 26, wherein the at least one side panel is attached to the at least one corner panel, and the method further comprises reconfiguring the container from the first configuration to a second configuration comprising moving the at least one end panel to cause movement of the at least one side panel such that the at least one side panel, the at least one end panel, and the at least one corner panel are generally upright relative to the bottom panel with the gusset in an expanded arrangement.

28. The method of claim 26, wherein the at least one corner panel comprises an end section separated from the at least one end panel at a cut and a side section foldably connected to the at least one side panel at a fold line.

29. The method of claim 28, wherein the gusset of the liner comprises a first gusset panel foldably connected to the at least one marginal panel and a second gusset panel foldably connected to each of the first gusset panel and the central panel.

30. The method of claim 29, wherein, in the folded arrangement of the gusset, a portion of the at least one marginal panel is in face-to-face contact with the first gusset panel, the first gusset panel is in face-to-face contact with the second gusset panel, and the second gusset panel is in face-to-face contact with a portion of the central panel.

31. The method of claim 30, wherein, in the folded arrangement of the gusset, a portion of the at least one marginal panel is in face-to-face contact with a portion of the central panel.

32. The method of claim 26, wherein, in the second configuration of the container, the at least one marginal panel extends past a top edge of the at least one side panel.

33. The method of claim 25, wherein the at least one marginal panel of the liner is a first marginal panel foldably connected to a first gusset, and the liner further comprises a second marginal panel foldably connected to a second gusset, each gusset foldably connected to the central panel.

34. The method of claim 33, wherein each gusset comprises a first gusset panel foldably connected to a second gusset panel, the second gusset panel foldably connected to the central panel.

35. The method of claim 34, wherein the at least one corner panel is a first corner panel and the at least one end panel is a first end panel separated from the first corner panel, the at least one side panel is a first side panel foldably connected to the first corner panel, and the plurality of panels further comprises a second end panel, a second corner panel foldably connected to the first side panel and separated from the second end panel, a second side panel, a third corner panel separated from the second end panel and foldably connected to the second side panel, and a fourth corner panel separated from the first end panel and foldably connected to the second side panel.

36. The method of claim 35, wherein each corner panel comprises an end section foldably connected to a side section.

37. The method of claim 25, wherein the blank is formed from paperboard and the liner is formed from a polymeric material.

* * * * *